US006180923B1

(12) United States Patent
Yang

(10) Patent No.: US 6,180,923 B1
(45) Date of Patent: Jan. 30, 2001

(54) SPINNING TRAY FOR OVEN

(76) Inventor: Po-Han Yang, No. 56, Min Sheng Street, Feng-Yuan City 42041 (TW)

( * ) Notice: Under 35 U.S.C. 154(b), the term of this patent shall be extended for 0 days.

(21) Appl. No.: 09/414,918

(22) Filed: Oct. 8, 1999

(51) Int. Cl.[7] ..... H05B 6/78; A47B 11/00

(52) U.S. Cl. ..... 219/392; 219/389; 219/754; 126/338; 108/20; 99/443 R

(58) Field of Search ..... 219/754, 755, 219/392, 386, 388, 389; 126/338; 108/20, 139, 138; 99/443 R

(56) References Cited

U.S. PATENT DOCUMENTS

| | | | | |
|---|---|---|---|---|
| 4,239,009 | * | 12/1980 | Cunningham | 219/755 |
| 4,254,319 | * | 3/1981 | Beh et al. | 219/755 |
| 4,523,070 | * | 6/1985 | Jorgensen et al. | 219/755 |
| 5,667,714 | * | 9/1997 | Cho | 219/754 |
| 5,672,291 | * | 9/1997 | Han | 219/753 |

* cited by examiner

*Primary Examiner*—Philip H. Leung

(57) ABSTRACT

The present invention of a spinning tray for oven mainly includes a tray body for placing food. The tray body having a hole at its center for inserting a sensor rod. A spring is disposed underneath the sensor rod, a positioning frame is placed outside the spring and is fixed underneath on the tray body. A lower board of the positioning frame is provided for the spring to be compressed against. A L-shaped stopping bar is extended from the bottom of the sensor rod. A spinning mechanism includes a positioning board, few stand poles are disposed vertically underneath on the tray body for screwing to the positioning board by screws. A main axle goes through the positioning board. The main axle is wrapped around by a spring and is sleeved with a gearing. The main axle engages with the gearing by the elasticity provided by the spring. The gearing is engaged to few gear sets and a spinning blade is activated by a gear wheel. The whole spinning mechanism is covered by a cover and is fixed on the positioning board. A bottom box which accommodates the spinning mechanism therein between the bottom of the tray body. The bottom box having a fixing hole at its center for the end of main axle to go through. A bottom tray is for the end of the main axle to screw on. Accordingly, spins the bottom tray to turn the main axle.

4 Claims, 6 Drawing Sheets

SPINNING TRAY FOR OVEN

BACKGROUND OF THE INVENTION

The present invention relates to ovens and more particularly to an oven with a mechanism that can spin automatically without a motor.

Ovens are becoming very popular in cooking due to its convenience and relative cheap price to micro-ovens. It is also safer, free from fearing that microwave causes harm to our bodies. Because conventional ovens don't have spinning tray, food usually get cooked unevenly, some parts are fully cooked while others may still be raw or half-cooked. Even though some improved ovens have spinning tray provided with a motor underneath, but it is expensive and the motor may get broken very easily.

SUMMARY OF THE PRESENT INVENTION

The present invention of a spinning tray for oven mainly comprising a tray body, a spinning mechanism, a bottom box and a bottom tray. The spinning tray is for holding food, having a hole at the center for inserting a sensor rod with a spring coil underneath. A positioning frame is disposed outside the spring coil and underneath the tray body. A lower board of the positioning frame is provided for defining the spring when it is compressed. The sensor rod having a L-shaped stopping bar extended therefrom. The spinning mechanism comprising a positioning board. The tray body having few stand poles protruded from underneath for screwing the positioning board. A main axle penetrates through the positioning board on a preset location. The main axle having a spring around and a gearing sleeved on it, so that the main axle can engage with the gearing by the elasticity of the spring, the gearing is also engaged to few gear sets to spin a spinning blade. The whole spinning mechanism is covered by a cover and is fixed by screwing on the positioning board. The bottom box is for placing the spinning mechanism between itself and the tray body. The bottom box having an axial hole at the center for the main axle of the spinning mechanism to go through. Heat insulation material is provided inside the bottom box and the tray body. The bottom box and the tray body are fixed together in a way that they spin in the same pace. The bottom tray is a plate-liked body with a screw hole on its top for screwing the end of the main axle of the spinning mechanism. Accordingly, spin the bottom tray together with the main axle so that the spring is winded. When the sensor rod on the tray body is pressed by food, the stopping bar moves downwards away from the spinning blade, so that the spring creates elasticity to spin the spinning mechanism and the tray body while the main axle and the bottom tray remain motionless. When the food is taken away from the tray body to release the sensor rod from pressure and returns to its original position, the stopping bar rises up to stop the spinning blade from moving, so that the spinning mechanism is motionless too. Thus the present invention of a spinning tray for oven can spin automatically when food is placed on top without a motor or electricity, food can also be cooked evenly.

The present invention will become more fully understood from the following detailed description when taken in conjunction with the accompanying drawings.

DETAILED DESCRIPTION OF THE PREFERRED EMBODIMENT

Figure 1:
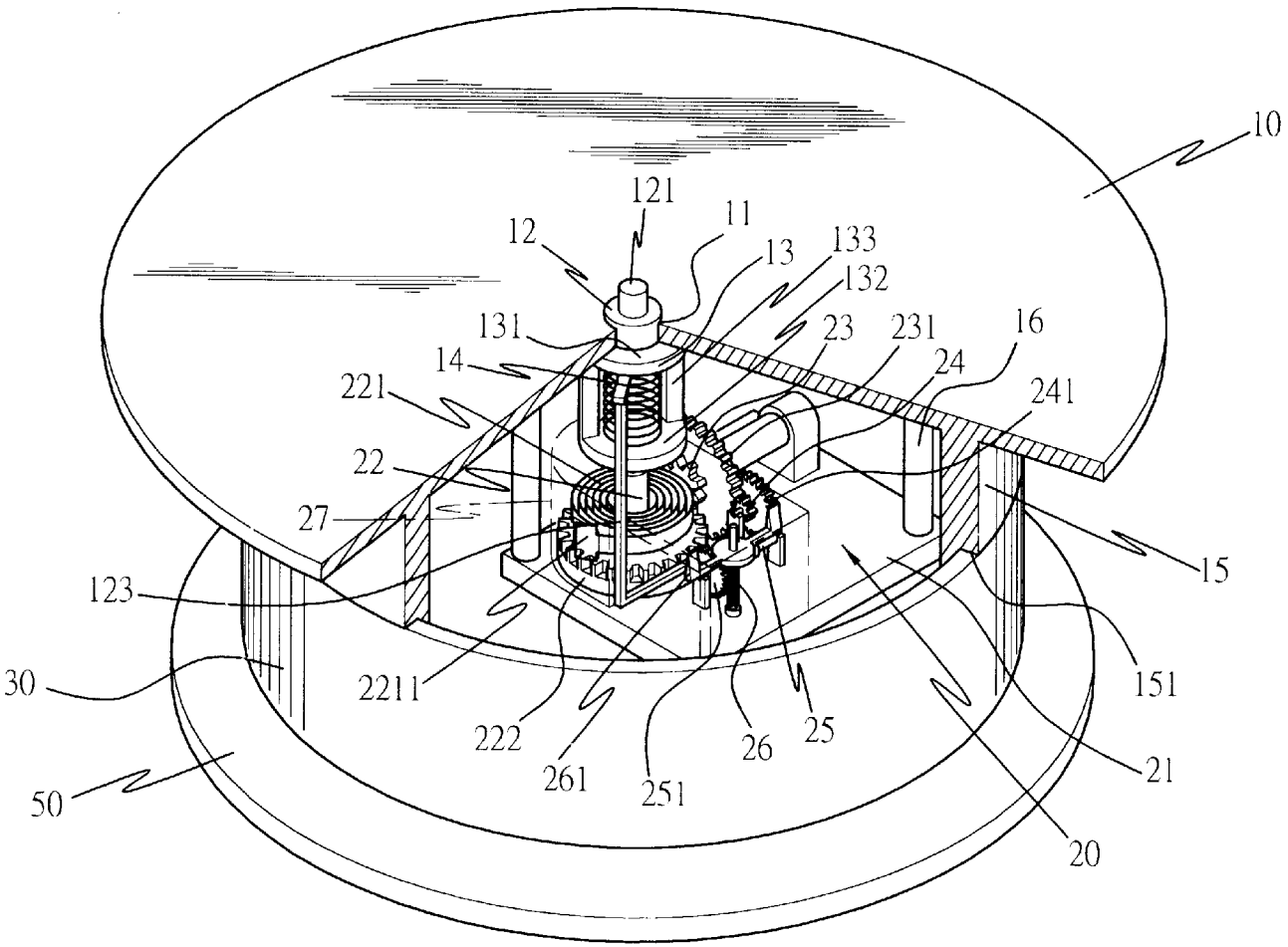
FIG. 1 is a perspective view of the present invention.
Figure 2:
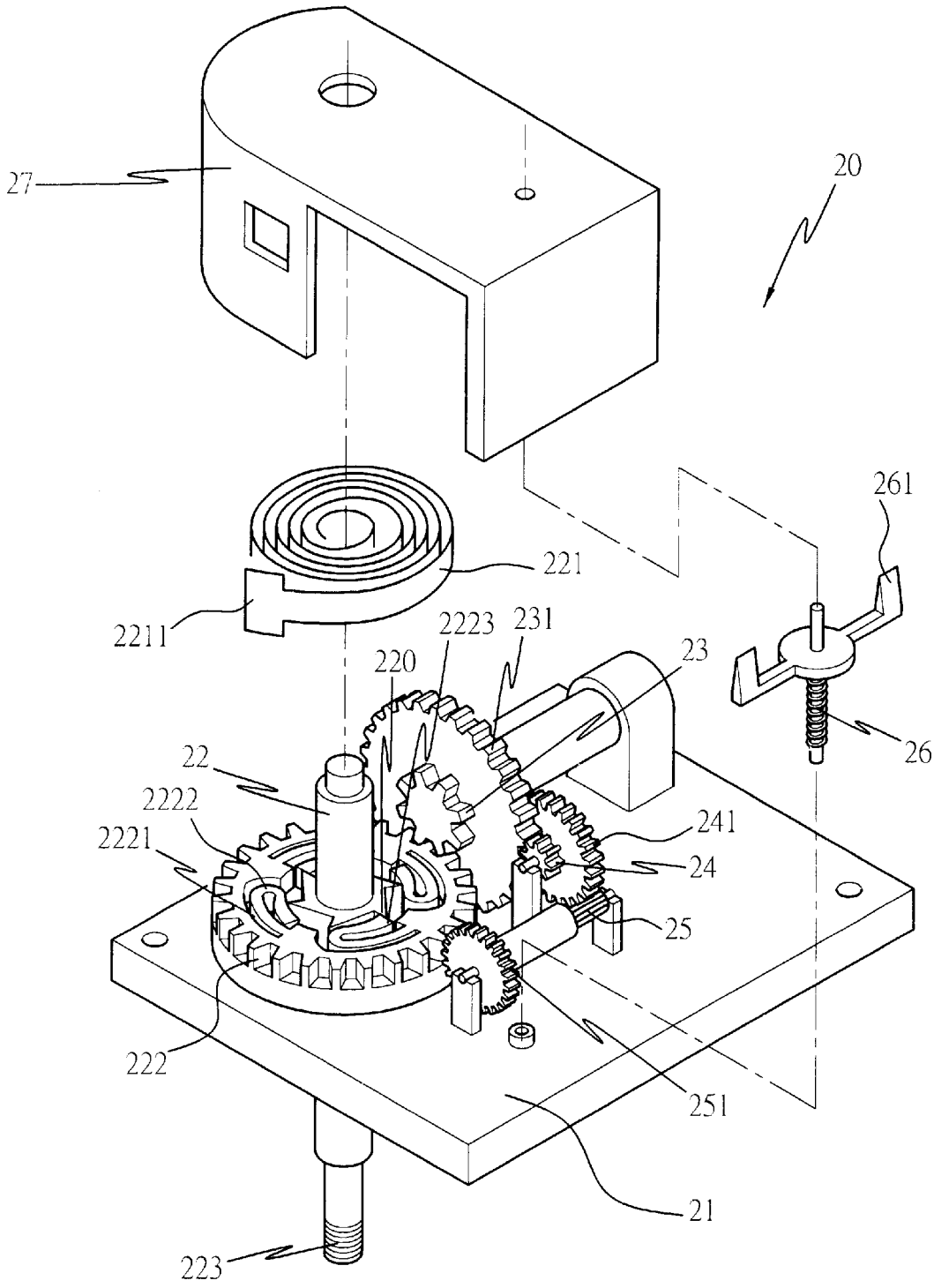
FIG. 2 is an exploded perspective view of the spinning mechanism of the present invention.
Figure 3:
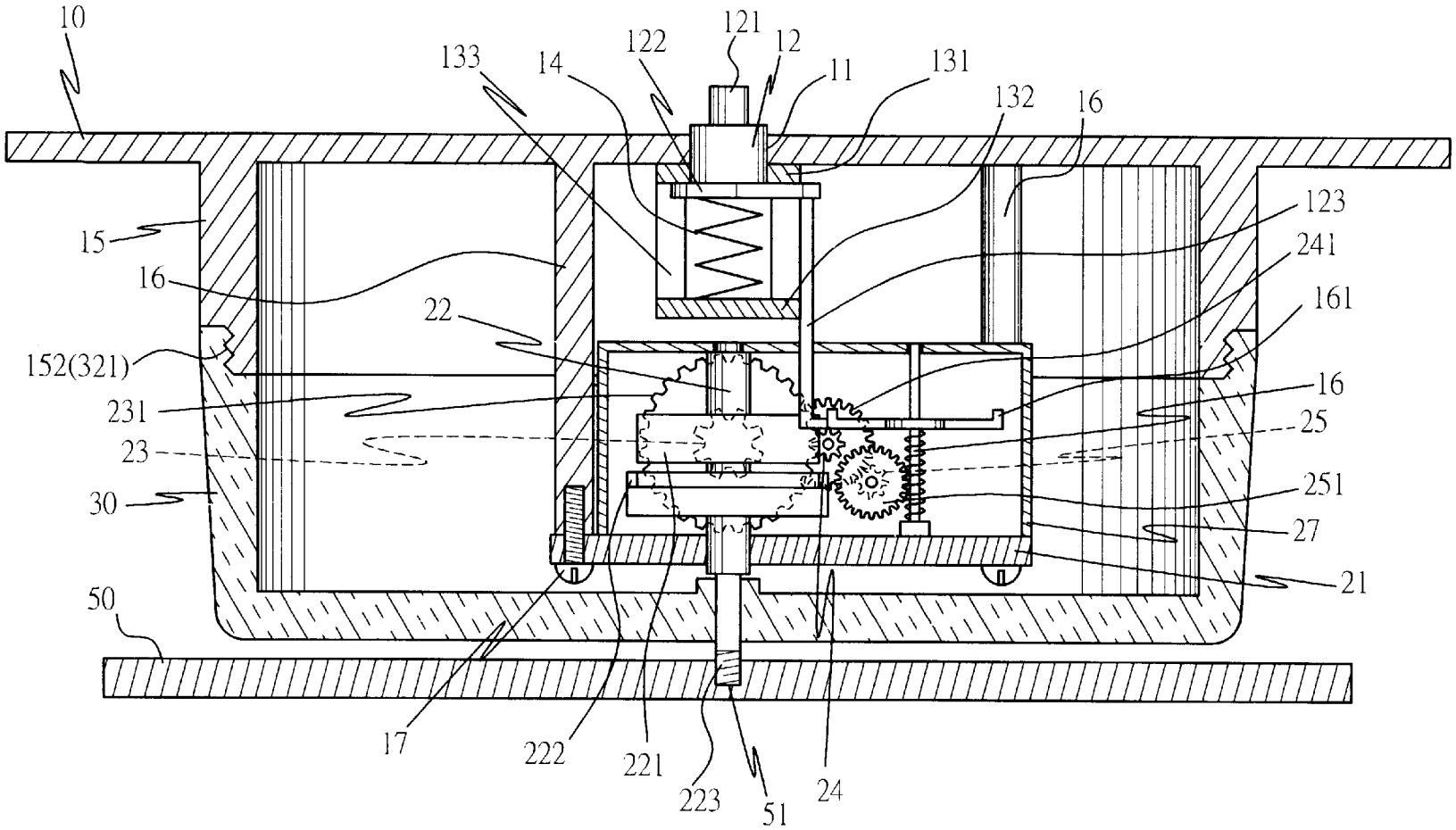
FIG. 3 is a sectional view of the present invention.
Figure 4:
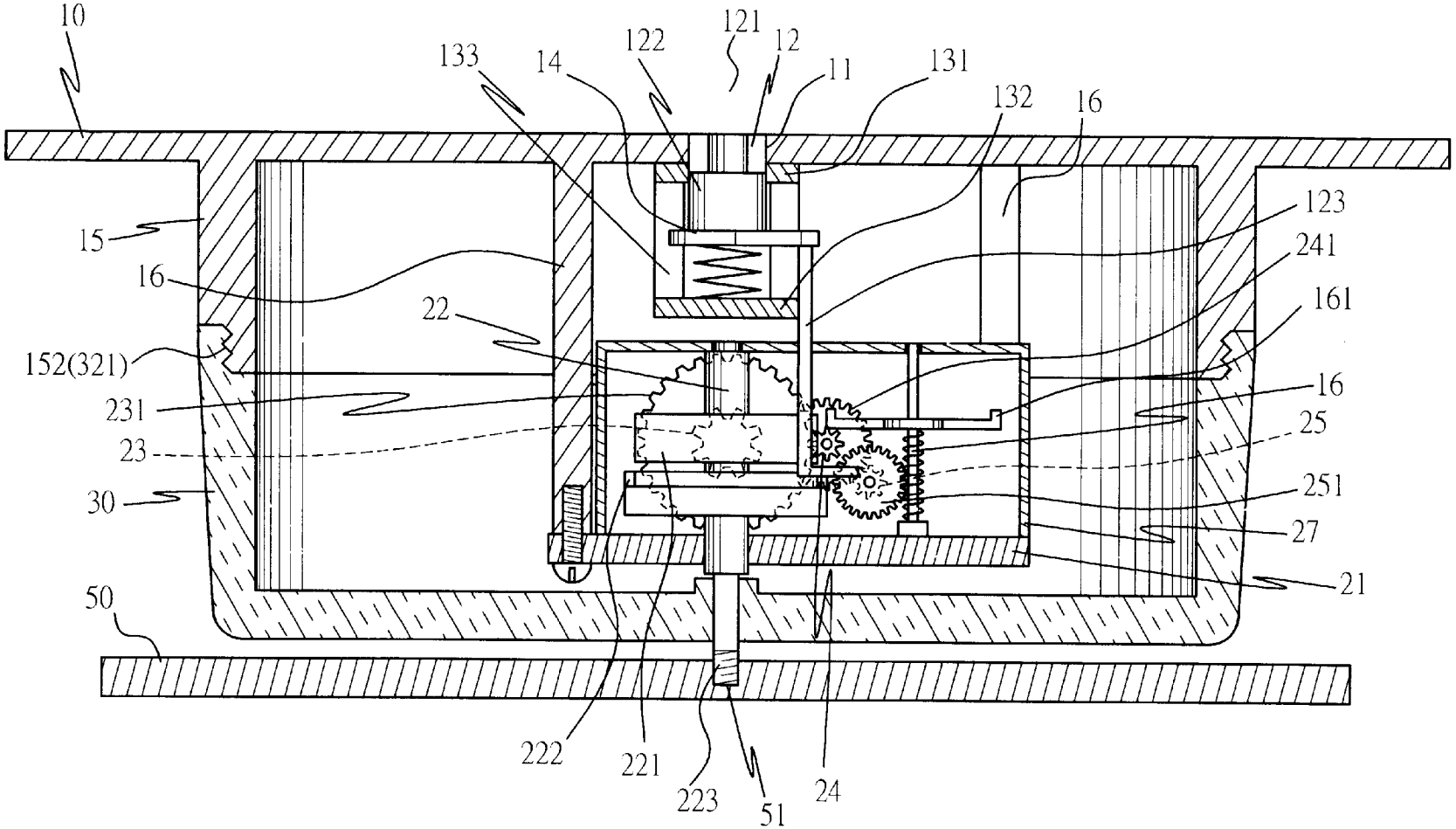
FIG. 4 is a sectional view of the present invention when the sensor rod is compressed and the stopping rod stops the spinning blade from spinning.
Figure 5:
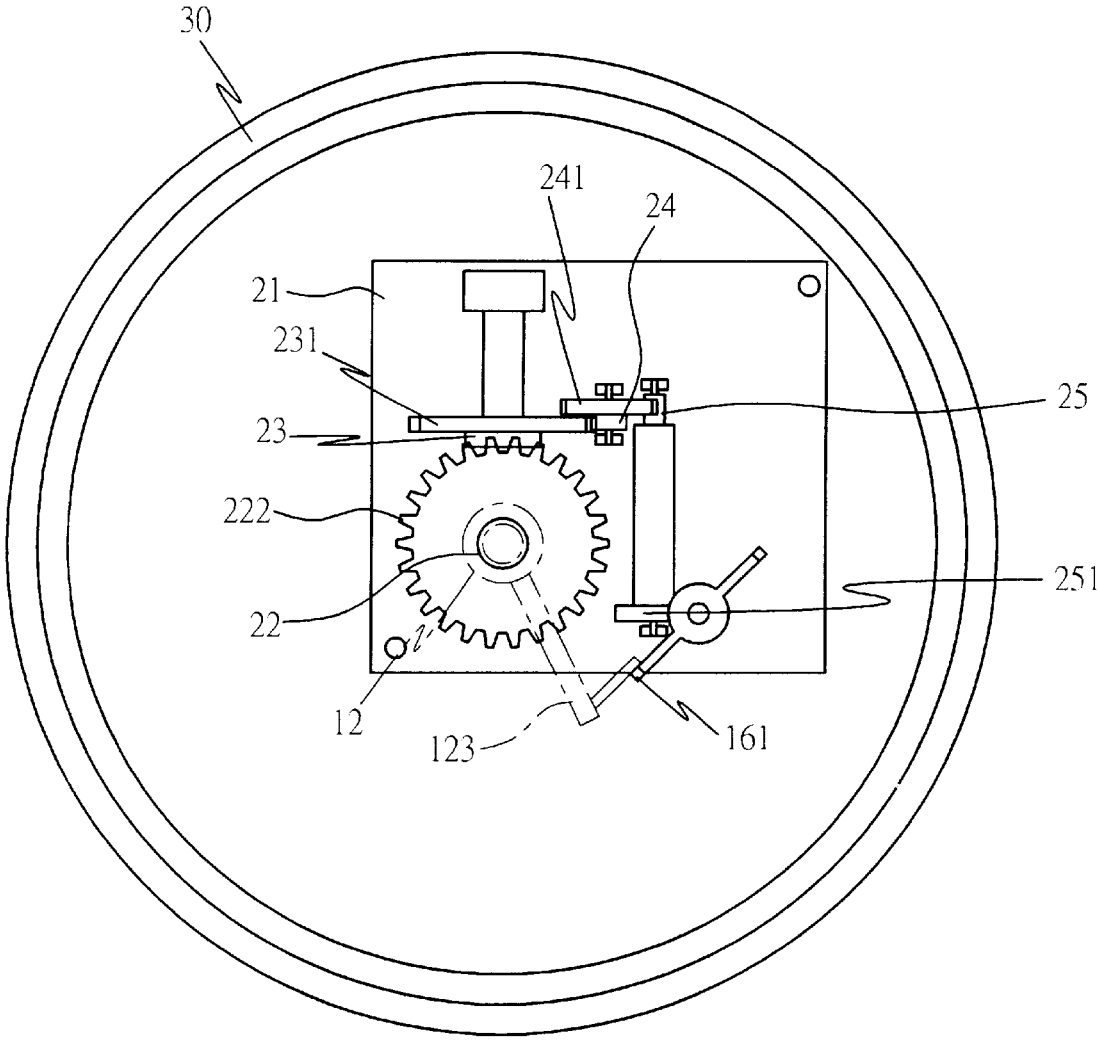
FIG. 5 is a top plane view of the spinning mechanism of the present invention.

Referring to FIGS. 1, 2 and 3, the present invention mainly comprising a tray body 10, a spinning mechanism 20, a bottom box 30 and a bottom tray 50. The tray body 10 can place food with a hole 11 at its center for a sensor rod 12 to go through. The sensor rod 12 having a mini pole 121 on top as well as a mini board 122 and a L-shaped stopping bar 123 underneath. The sensor rod 12 goes through a positioning frame 13 which is fixed on the bottom of the tray body 10. The positioning frame 13 having an upper board 131, a lower board 132 and a vertical bar 133. A spring coil 14 is placed inside the positioning frame 13. The upper end of the spring coil 14 is pressed against the mini board 122 of the sensor rod 12. When the mini pole 121 of the sensor rod 12 is being pressed, the stopping bar 123 moves downwards, vice versa, the stopping bar 123 moves upwards to its original position when the mini pole 121 is released from pressure. The tray body 10 having a lower circumference ring 15 and two stand poles 16 underneath. An upside-down L-shaped indentation 151 with an outer screwing pattern 152 for the top edge of the bottom box 30 to screw together, is disposed on the bottom edge of the lower circumference ring 15.

The spinning mechanism 20 having a positioning board 21 with screws 17 underneath for fixing to the stand poles 16. A main axle 22 goes through the positioning board 21. A spring 221 is wrapped around the main axle 22, a gearing 222 is also sleeved on the main axle 22. The inner end of the spring 221 is fixed to the main axle 22 while an outer end 2211 of the spring 221 is engaged with the inner slot 2221 of the gearing 222. Few curved elastic pieces 2222 are disposed inside the gearing 222, inclined teeth 220 are corresponding to the curved elastic pieces 2222 of the gearing 222. If the main axle 22 is spin anti-clockwise (means the gearing remains motionless), it causes the spring 221 to wind up. When release the main axle 22, the inclined teeth 220 of the main axle 22 are engaged with the pieces ends 2223 of the curved elastic pieces 2222 of the gearing 222, so that the main axle 22 and the gearing 222 remain motionless. The curved elastic pieces 2222 and the inclined teeth 220 are designed in such a way that the main axle 22 can only spin in anti-clockwise direction to wind up the spring 221, the main axle 22 engages with the gearing 222 if is turned clockwise. The gearing 222 can be engaged to a vertical small gear 23 which is in one body with a big gear 231. The big gear 231 is then engaged to a axial gear 24, the axial gear 24 is in one body with a middle gear 241. The middle gear 241 is then engaged with a horizontal gear rod 25 with a gear wheel 251 on the other end. The gear wheel 251 is engaged with a spinning rod 26 which has screw pattern to spin a spinning blade 261. The L-shaped stopping bar 123 can move downwards to stop the spinning blade 261 from spinning. All of the mentioned gear sets have horizontal and vertical bar and are covered by a cover 27. The bottom end of the main axle 22 goes through the positioning board 21 and the bottom box 30 and is exposed outside with a screw portion 223. A fixing hole 31 at the center of the bottom box 30 is corresponding to the screw portion 223 of the main axle 22. The screw portion 223 of the main axle 22 can be screwed clockwise to a screw hole 51 of the bottom tray 50. The main axle 22 is turned anti-clockwise when the bottom tray 50 is spin anti-clockwise. An inner screwing pattern 321 at a top edge 32 of the bottom box 30 engages with the outer screwing pattern 152 of the indentation 151 of the tray body 10, so that the tray body 10 and the bottom box 30 spin together. The bottom surface of the tray body 10, the lower circumference 15 and the bottom box 30 are made with heat-insulated material.

Accordingly, spinning the bottom tray 50 turns the main axle 22. When the bottom tray 50 remains motionless, the sensor rod 12 is pressed and causes the spinning mechanism 20 to work. Thus the positioning board 21 turns and causes the tray body 10 to spin anti-clockwise, so that the spring 221 releases elasticity. Firstly, spins the bottom tray 50 in anti-clockwise direction to turn the main axle 22, so that the spring 221 is winded up. At this moment, the stopping bar 123 underneath the sensor rod 12 still stops the spinning blade 261 from spinning, thus the whole spinning mechanism 20 remains motionless. If food is placed on top of the tray body 10, the sensor rod 12 is pressed downwards and causes the stopping bar 123 moves downwards, so that the spinning blade 261 is released from the stopping bar 123. Therefore, the spinning blade 261 can spin and so does the spinning mechanism 20.

When the spinning mechanism 20 can work, the store elasticity of the spring 221 provides energy for the main axle 22 to turn clockwise. The main axle 22 is fixed to the bottom box 30 and remains motionless, so does the gearing 222 because it is also engaged to the main axle 22. Therefore, the positioning board 20 is forced to turn anti-clockwise with the main axle 22 as its axle. Thus the small gear 23 moves and causes the spinning mechanism 20 to work. The small gear 23 turns with the big gear 231 and causes the axial gear 24 to turn together with the middle gear 241. The gear wheel 251 also turns because the gear rod 25 is engaged to the axial gear 241. The spinning blade 261 can finally turn because the spinning rod 26 is engaged with the gear wheel 251. The positioning board 20 can spin because of the elasticity provided by the spring 221, and the positioning board 20 is fixed underneath the tray body 10, thus the tray body 10 can spin together with the bottom box 30. The sensor rod 12 moves upwards when food is removed from the tray body 10, the stopping bar 123 moves upwards and stops the spinning blade 261 from spinning, thus the spinning mechanism 20 stops working and so does the tray body 10.

Different types of the spring 221 can provide elasticity in various degrees for the tray body 10 to spin over few hours. The spin time can be set by adjusting the spin times of the tray body 10.

Figure 6:
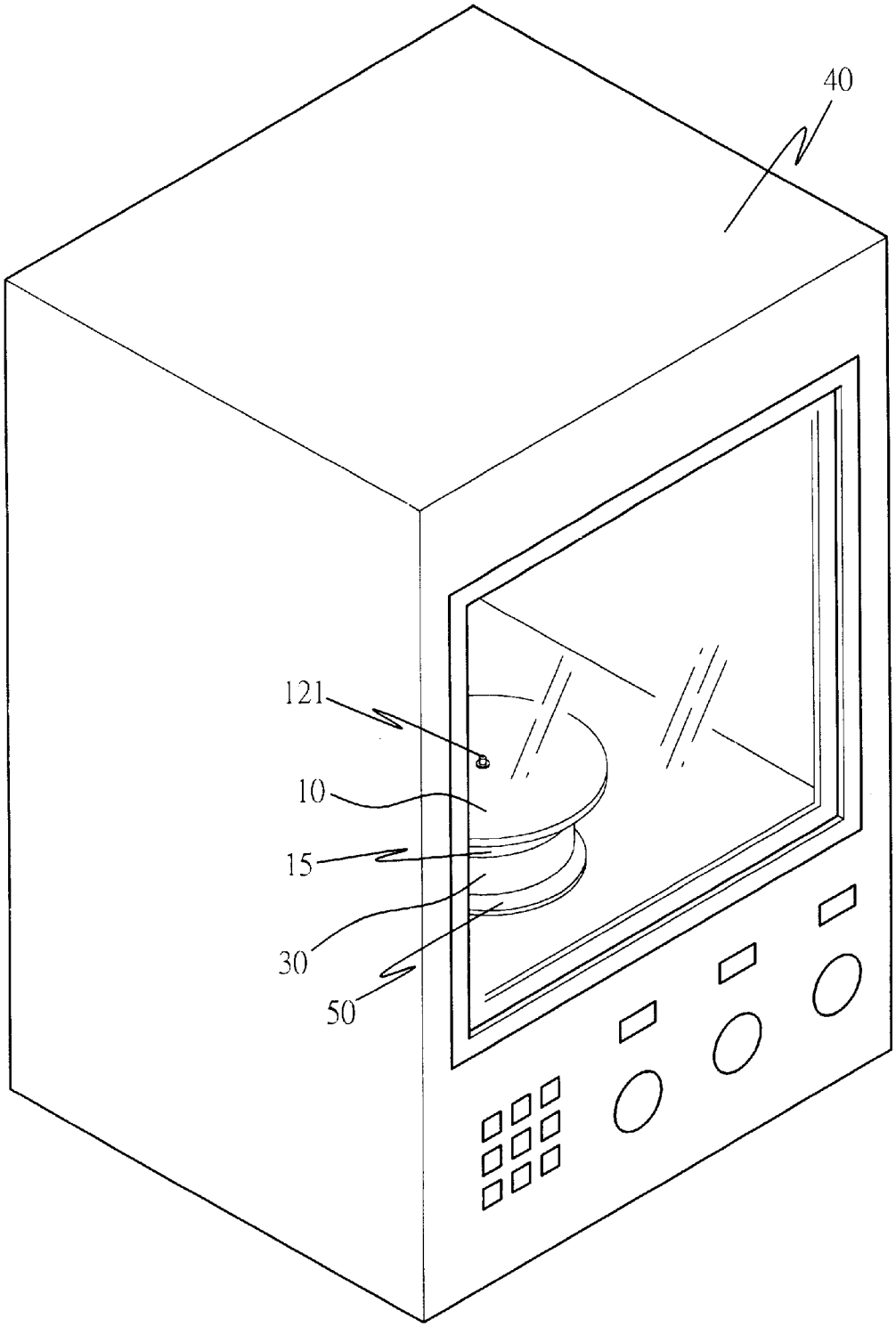
FIG. 6 is a perspective view of the present invention when is placed inside an oven.

Referring to FIG. 6, the present invention can be employed in an oven 40 without spinning tray. The mini pole 121 of the sensor rod 12 is little higher so as be able to touch the indented bottom of ordinary plates or containers. The bottom box 30 is not too high and thus doesn't affect the volume of the oven 40 which is ideal for big sized ovens for food needed longer cooking time.

Although the invention has been explained in relation to the preferred embodiment, it is to be understood that many other possible modifications and variations can be made without departing from the spirit and scope of the invention as hereinafter claimed.

I claim:

1. A spinning tray for an oven, comprising:

a tray body for supporting food, the tray body having a hole with a sensor rod extending therethrough, a spring coil disposed underneath the sensor rod, a positioning frame fixed on the bottom of the tray body and enclosing the spring coil, the positioning frame including a lower board for the spring coil to be compressed against, a L-shaped stopping bar extending from the bottom of the sensor rod;

a spinning mechanism having a positioning board, a plurality stand poles disposed vertically underneath the tray body and fixed to the positioning board, a main axle extending through the positioning board and having a spring wrapped around it and a gearing sleeved on it, the main axle being engageable with the gearing by elasticity provided by the spring, a plurality of gear sets engaged to the gearing to spin a spinning blade and the whole spinning mechanism being covered by a cover fixed to the positioning board;

a bottom box enclosing the spinning mechanism and having a fixing hole disposed at the center of the bottom box for the main axle of the spinning mechanism to go through, inner surface of the bottom box and the tray body being made of heat insulating material, the bottom box and the tray body being connected together so that both can spin together at a same pace; and a bottom tray having a plate-like body with a screw hole on its top for the end of the main axle of the spinning mechanism;

whereby spinning of the bottom tray turns the main axle to wind up the spring, when the sensor rod on the tray body is pressed by the presence of food, the stopping bar moves downward away from the spinning blade to cause the spinning mechanism to spin the tray body and when food is taken away from the tray, the sensor rod is released and returns to its original position to cause the stopping bar to move upward and stop the spinning blade and the tray body from spinning.

2. A spinning tray for over as claimed in claim 1 as claimed in claim 1 wherein the gear sets of the spinning mechanism comprising a small gear together with a big gear in one body, an axial gear together with a middle gear in one body, a gear rod together with a gear wheel as well as a spinning rod, the gearing underneath the main axle is engaged with the small gear, the small gear turns together with the big gear in one body, the big gear is engaged with an axial gear which is together with the middle gear in one body, the middle gear is engaged with the gear rod, the gear wheel is disposed at the other end of the gear rod, the gear wheel is engaged with the spinning rod, the spinning rod with the spinning blade on its top is fixed on the positioning board.

3. A spinning tray for over as claimed in claim 1 as claimed in claim 1 wherein the tray body having a lower circumference ring with an outer screwing pattern for engaging with an inner screwing pattern disposed inside the top of the bottom box.

4. A spinning tray for over as claimed in claim 1 as claimed in claim 1 wherein the gearing of the spinning mechanism having a plurality of curved elastic pieces disposed inside, each elastic piece forms an inner slot and a piece end for stopping purpose, inclined teeth are disposed on the main axle in corresponding to the elastic pieces, the inclined teeth can turn idly in a single direction inside the gearing to wind up the spring, and are stopped at the pieces ends of the elastic pieces, the inner slot is for engaging with an outer end of the spring.

* * * * *